United States Patent [19]

Lind

[11] Patent Number: 4,721,255

[45] Date of Patent: Jan. 26, 1988

[54] ELECTROSTATIC RESISTIVE STUD

[75] Inventor: Robert J. Lind, Robbinsdale, Minn.

[73] Assignee: Graco Inc., Minneapolis, Minn.

[21] Appl. No.: 841,278

[22] Filed: Mar. 19, 1986

[51] Int. Cl.[4] ..... B05B 5/02

[52] U.S. Cl. ..... 239/690

[58] Field of Search ..... 239/690, 691, 697, 3, 239/704–707, 708, DIG. 14; 427/27, 30

[56] References Cited

U.S. PATENT DOCUMENTS

| | | | |
|---|---|---|---|
| 3,248,059 | 4/1966 | Fisher et al. | 239/707 |
| 3,292,860 | 12/1966 | Williams et al. | 239/15 |
| 3,339,841 | 9/1967 | Beach | 239/707 |
| 4,214,709 | 7/1980 | Scull et al. | 239/707 |
| 4,235,381 | 11/1980 | Vila | 239/696 |
| 4,241,880 | 12/1980 | Hastings | 239/691 |
| 4,258,885 | 3/1981 | Legeza | 239/707 |
| 4,335,851 | 6/1982 | Hastings | 239/3 |
| 4,368,852 | 1/1983 | Sharp et al. | 239/695 |
| 4,381,081 | 4/1983 | Hastings | 239/707 |
| 4,478,370 | 10/1984 | Hastings | 239/707 |
| 4,497,447 | 2/1985 | Mommsen | 239/691 |

FOREIGN PATENT DOCUMENTS

| | | | |
|---|---|---|---|
| 697378 | 11/1965 | Italy | 239/706 |
| 1038865 | 8/1966 | United Kingdom | 239/706 |
| 952356 | 8/1982 | U.S.S.R. | 239/706 |

*Primary Examiner*—Andres Kashnikow
*Assistant Examiner*—Kevin Patrick Weldon
*Attorney, Agent, or Firm*—Douglas B. Farrow

[57] ABSTRACT

A fluid stud and resistor design for electrostatic spray guns has a fluid passage which is shaped like a cloverleaf in cross section. By providing this cross-sectional shape, the resistor is allowed to reside in one wall of the fluid stud and run, nearly, the complete length of the stud, thereby providing an increased effective resistor length, thus reducing flash-over and providing a smaller contact wire, thereby reducing capacitance. The design of the fluid needle and electrode is provided so as to reduce the length of the electrode wire, thereby reducing capacitance and allowing an increased diameter wire for increased durability.

3 Claims, 3 Drawing Figures

ELECTROSTATIC RESISTIVE STUD

BACKGROUND OF THE INVENTION

Electrostatic spray guns are well-known and have been used for a number of years now. It has always been the desire of designers of such guns to reduce the capacitance, that is, the amount of energy storage in the front end of the gun and to provide an efficient resistor system there so that the gun is as safe and efficient as possible.

Two recent representative designs in this area are shown in U.S. Pat. Nos. 4,241,880 and 4,497,447.

SUMMARY OF THE INVENTION

The invention described herein is particularly applicable with electrostatic spray guns of the type shown in the aforementioned U.S. Pat. No. 4,497,447, the contents of which are herein incorporated by reference.

The fluid valve member is similar to that shown in the above-referenced patent but rather than the electrode extending outwardly from the center of the valve member and then forwardly, the electrode contact portion extends outwardly and then rearwardly. This design allows the length of the electrode member to be minimized, thereby minimizing the capacitance of that piece and allowing the use of a larger more durable diameter of wire material.

The fluid passage located between the valve member and the fluid stud is cloverleaf shaped over a substantial portion of its length. Rather than the resistive member being tubular in nature, as disclosed in the above-referenced patent, the resistor is instead cylindrical in shape and lies parallel to and between two outwardly extending lobes on one side of the fluid passage. This construction allows the resistor to have a much greater length, thereby providing a much longer distance between the exposed ends of the resistor. This substantially reduces the potential of surface flash-over, which would allow energy to bypass the resistor. By allowing the resistor to extend all the way to the rear of the fluid stud, this design also allows a simple contact wire to mate with the conductive member connected to the power supply. The use of this simple contact wire provides a much lower capacitance design than the previous spring contact member shown in the above-referenced '447 patent.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
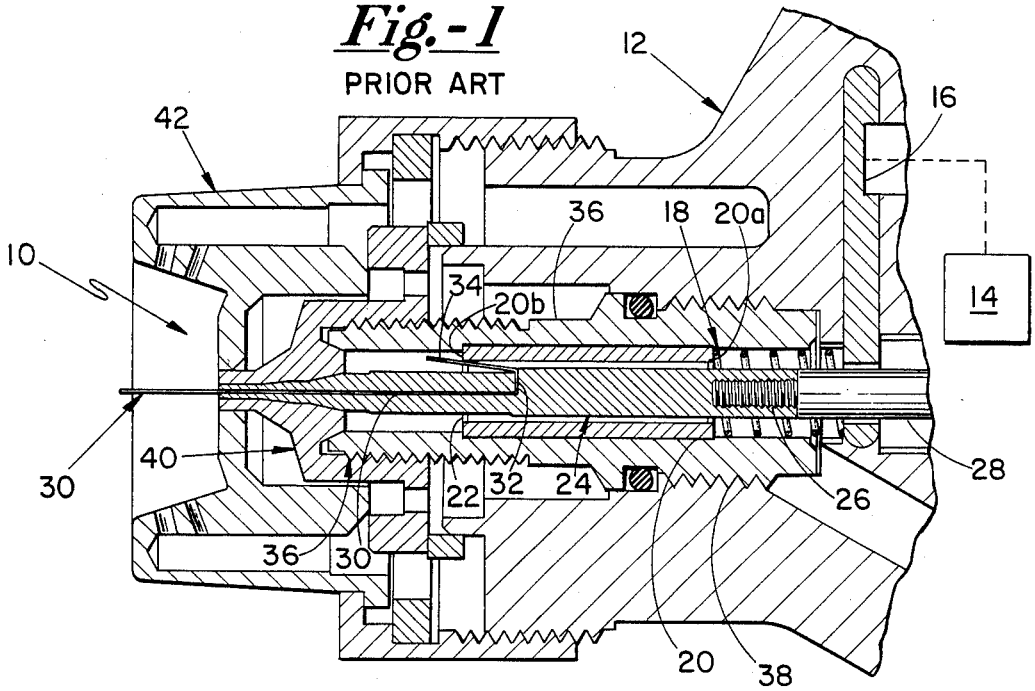
Fig.-1 PRIOR ART
FIG. 1 is a cross-sectional view of the front end of an electrostatic spray gun showing a prior art design similar to that shown in the aforementioned '447 patent.

A typical prior art design is shown for convenience in FIG. 1. It basically shows the construction disclosed in U.S. Pat. No. 4,497,447. In FIG. 1, the spray gun, generally designated 10, is provided with a gun body 12 having a power supply 14 therein which is connected to a conductive member 16. A contact spring 18 serves to electrically connect and provide a conductive interface between conductive member 16 and tubular resistor 20. Tubular resistor 20 is provided with a rear end **20*a* which is contacted by spring 18 and a front end 20*b*. A metal ring 22 at the front end 20*b* of tubular resistor 20** provides contact surface.

Fluid valve member 24 is slideably located within tubular resistor 20, and has a threaded portion 26 at the rear end thereof for accepting the threaded trigger rod 28. An electrode wire 30 extends from the front end of fluid valve 24 and is provided with a radially extending transition portion 32 and a forwardly extending contact portion 34, which in turn contacts conductive ring 22, as mentioned above. Fluid stud 36 is threaded into gun body 12 by means of threads 38 and has tubular resistor 20 molded into the interior thereof. A fluid nozzle tip 40 and air cap 42, of conventional design, complete the prior art device. A more complete description of the construction and operation of this device may be found in the aforementioned 447 patent.

Figure 3:
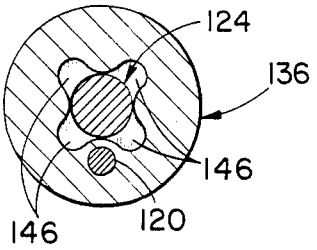
FIG. 3 is a sectional view taken along line 3—3 of FIG. 2.
Figure 2:
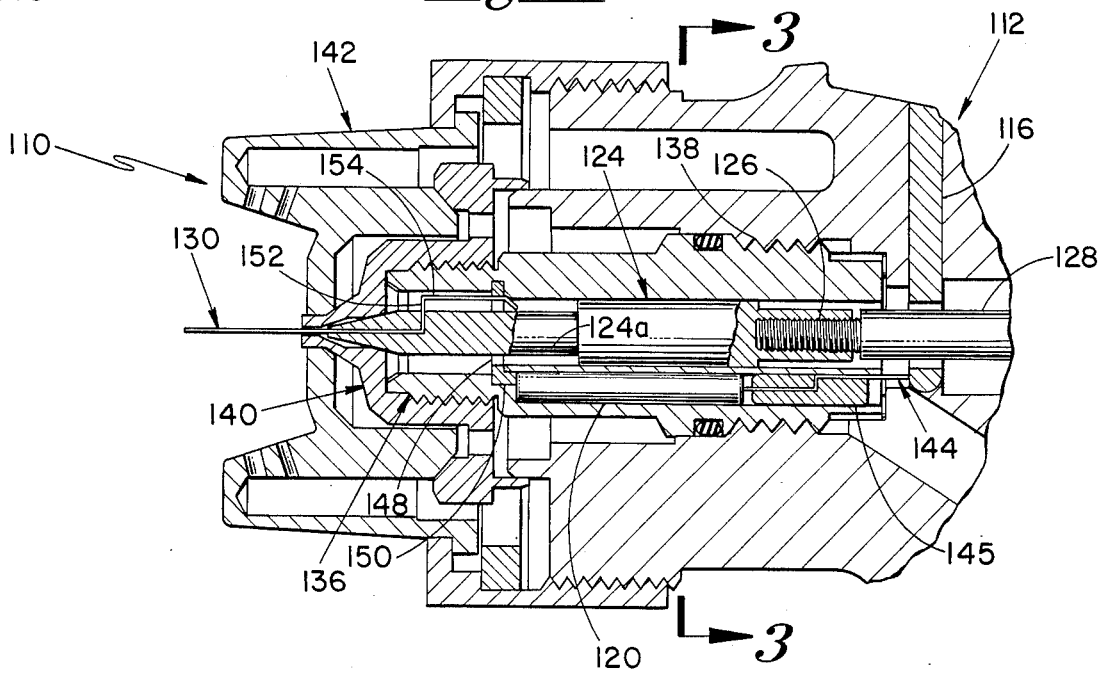
FIG. 2 shows a view similar to that of FIG. 1 of the invention of the instant application.

The design of the instant invention is shown in FIG. 2, where possible, similar numbers have been used to the construction shown in FIG. 1 for the purpose of pointing out similarly functioning parts. The spray gun, commonly designated 110, is provided with a gun body 112 having a conductive member 116 therein. A resistor 120 is generally cylindrical in shape and is shown in FIGS. 2 and 3 as being located in the wall of fluid stud 136. Fluid valve 124 is provided with a reduced diameter portion **124*a*. The rear of fluid valve 124 is provided with a threaded portion 126 for receiving a trigger control rod 128. A wire-like electrode member 130 extends from the front end of fluid valve reduced portion 124*a*. A transition section 152, of electrode 130, extends radially outwardly from fluid valve 124*a* and is joined to contact section 154 of electrode 130 which runs rearwardly into contact with conductive ring 148. Conductive ring 148 is molded into fluid stud 136 and, in turn, has a contacting portion 150, which makes contact with the front end of resistor 120**.

The rear end of resistor 120 is contacted by a contact wire 144, which is embedded in a plug 145, which runs parallel to resistor 120. Plug 145 serves to seal the end of resistor 120 from exposure and allows only contact wire 144 to contact conductive member 116.

In a conventional matter, fluid stud 136 is provided with a threaded portion 138 which threads into gun body 112. FIG. 3 shows particularly fluid passage 146, which is cloverleaf shaped in nature and provided between the interior wall of stud 136 and the exterior of valve member 124. As can be seen, resistor 120 is located between the lobes of the cloverleaf at a location where the passage has a reduced diameter relative to the diameter at the lobes of the cloverleaf.

Again, relatively conventional fluid tip 140 and air cap 142 are utilized to complete the front end of the spray gun. It can be appreciated, of course, that this construction is suitable for use with various types of power supplies and air caps and the like, those details to not form a part of the instant invention.

It is contemplated that various changes and modifications may be made to the electrostatic resistive stud without departing from the spirit and scope of the invention as defined by the following claims.

What is claimed is:

1. In an electrostatic spray gun of the type having fluid passages therein for the passage of fluid therethrough, and having passages therethrough for containing electrically conductive components for carrying a voltage to a forwardly projecting electrode, the electrode and a forwardmost fluid passage being in axial alignment, the improvement comprising:

a fluid ejection orifice proximate the forward end of said forwardmost fluid passage;

a fluid valve adapted for seating in fluid sealing relationship in said fluid ejection orifice;

a conductor in said fluid valve, said conductor having a segment projecting forwardly through said fluid ejection orifice to form said forwardly projecting electrode, and said conductor having a further segment projecting outwardly then rearwardly from said fluid valve into said forwardmost fluid passage;

a fluid stud having a rear end and a passage through which said fluid valve passes;

a portion of said fluid passage being formed between said fluid stud and said fluid valve;

a resistive element having a forward end and being located in one side of said fluid stud and extending axially therethrough; and means electrically connecting said resistive element forward end with said rearwardly projecting segment, said resistive element extending from said connecting means said rear end.

2. In an electrostatic spray gun of the type having fluid passages therein for the passage of fluid therethrough, and having passages therethrough for containing electrically conductive components for carrying a voltage to a forwardly projecting electrode, the electrode and a forwardmost fluid passage being in axial alignment, the improvement comprising:

a fluid ejection orifice proximate the forward end of said forwardmost fluid passage;

a fluid valve adapted for seating in fluid sealing relationship in said fluid ejection orifice;

a conductor in said fluid valve, said conductor having a segment projecting forwardly through said fluid ejection orifice to form said forwardly projecting electrode, and said conductor having a further segment projecting outwardly then rearwardly from said fluid valve into said forwardmost fluid passage;

a fluid stud having a rear end and a passage through which said fluid valve passes, said passage having a cross-section with at least first and second radial dimensions at varying radial positions, said first dimension being less than said second dimension;

a portion of said fluid passage being formed between said fluid stud and said fluid valve;

a resistive element having a forward end and being located in one side of said fluid stud radially outwardly from said first dimension and extending axially therethrough; and means electrically connecting said resistive element forward end with said rearwardly projecting segment, said resistive element extending from said connecting means to said rear end.

3. The apparatus of claim 2 where said passage cross-section is generally cruciform in shape.

* * * * *